United States Patent [19]

Allwin

[11] Patent Number: 5,048,606

[45] Date of Patent: Sep. 17, 1991

[54] SETTING TOOL FOR A LINER HANGER ASSEMBLY

[75] Inventor: Roger P. Allwin, College Station, Tex.

[73] Assignee: Lindsey Completion Systems, Inc., Midland, Tex.

[21] Appl. No.: 579,547

[22] Filed: Sep. 10, 1990

[51] Int. Cl.[5] ..... E21B 23/00

[52] U.S. Cl. ..... 166/208; 166/216; 166/285; 166/382

[58] Field of Search ..... 166/208, 216, 217, 382, 166/72, 285, 237

[56] References Cited

U.S. PATENT DOCUMENTS

| | | | |
|---|---|---|---|
| 3,136,367 | 6/1964 | Wright et al. | 166/208 |
| 3,158,201 | 11/1964 | Springer | 166/208 X |
| 4,010,804 | 3/1977 | Garcia | 166/382 |
| 4,388,971 | 6/1983 | Peterson | 166/382 X |
| 4,562,889 | 1/1986 | Braddick | 166/381 |
| 4,580,631 | 4/1986 | Baugh | 166/208 |
| 4,598,774 | 7/1986 | Bevels et al. | 166/382 |
| 4,834,185 | 5/1989 | Braddick | 166/382 |

*Primary Examiner*—Stephen J. Novosad

[57] ABSTRACT

A setting tool for a liner hanger in an oil well completion system wherein the setting tool mechanism incorporates the necessary structure for manipulating a liner prior to and subsequent to hanging the liner hanger in a well casing. Prior to setting the liner hanger the setting tool is keyed to a liner hanger by longitudinal dogs in longitudinal grooves. After hanging the liner hanger, the dogs are released and rotation of the setting tool mandrel uncouples a coupling nut from the liner hanger to release the setting tool from the liner hanger and further rotation locks the setting tool mandrel to the clutch housing with a lock nut so that the liner hanger can be rotated after it is hung in a well casing.

23 Claims, 3 Drawing Sheets

SETTING TOOL FOR A LINER HANGER ASSEMBLY

RELATED APPLICATIONS

This application is related to application Ser. No. 07/579,654, filed 09/10/90, entitled Double Nut Setting Tool and Liner Hanger Assembly; and to application Ser. No. 07/579,653, filed 09/10/90, entitled Finger Nut Setting Tool and Liner Hanger Assembly.

FIELD OF THE INVENTION

This invention relates to setting tools for liner hangers in oil well completions, and more particularly to a setting tool which can be utilized to rotate a liner either before or after the liner hanger is hung in a well bore and which can be utilized with a wide variety of liner hangers.

BACKGROUND OF THE PRESENT INVENTION

During the drilling and completion of an oil well where a borehole traverses earth formations, it is customary to install one or more liners (tubular strings of pipe) in the borehole where the liners are cemented in the borehole by filling the annulus between the liner and the borehole with cement. In installing a liner (which is a string of pipe), the upper end of the liner is connected to a tubular liner hanger which typically has circumferentially arranged exterior slip or wall engaging members where the slip members are in a retracted condition while the liner hanger is lowered into the borehole. The slip members can be set to engage a wall by either hydraulically actuated means or mechanical mechanisms and the liner hanger usually has an interior left-hand thread which is used for releasably coupling the liner hanger to a tubular setting tool. The setting tool has a matching left-hand threaded release nut for coupling with the liner hanger and has a supporting tubular mandrel with a non-circular exterior portion which is slidably but non-rotatably connected in the bore of the release nut. Below the release nut the supporting mandrel has a load supporting cylindrically shaped, upwardly facing shoulder which engages the release nut so that the weight of the liner is carried by the release nut located on the mandrel shoulder. The upper end of the setting tool mandrel is connected to a string of pipe which is used to lower the liner and the liner hanger into position in the borehole. While lowering the liner into the borehole it is sometimes desirable to rotate the liner in right hand direction. This requires an ability to impart rotation to the liner hanger through the setting tool without rotating or releasing the release nut from the liner hanger. This type of rotation can be accomplished by utilizing a set of longitudinal interengaging splines located between the liner hanger an setting tool mandrel in a well known manner.

When a liner hanger is lowered to a position adjacent to the lower end of the next above casing or liner, the slip members on the liner hanger are set to engage with the surrounding pipe wall. Setting of the slip members can be accomplished by hydraulic actuation or by mechanical actuation.

A hydraulically operated liner hanger utilizes hydraulic pressure in the string of pipe and in the setting tool to actuate an axially movable hydraulic cylinder which moves and causes the slip members on the liner hanger to extend outwardly into gripping engagement with the wall of the surrounding casing or liner. In a mechanically actuated liner hanger, a friction block means on the liner hanger frictionally engage a casing or liner so that an interconnecting "J" slot release mechanism can be operated by manipulation of the setting tool to permit the slip members to be set.

If interengaging splines are used in the setting tool to enable rotation of a liner prior to the setting of the liner hanger slips, the splines in the setting tool can be disengaged after the liner hanger slips are set by longitudinal movement of the supporting string of pipe relative to the liner hanger. The non-circular portion of the mandrel permits longitudinal movement of the setting tool mandrel with respect to the release nut. After disengaging the setting tool splines, right-hand rotation of the string of pipe releases the threaded release nut from the interior threaded connection with the liner hanger. The setting tool in a released position in the liner hanger also has pressure sealing means located in the bore of the liner hanger so that the string of pipe is in fluid communication with the bore of the liner. In this condition, before removing the released setting tool from the liner hanger, a cement slurry is pumped down the string of pipe and the liner bore and out the end of the liner and into the annulus between the liner and the borehole.

The cement slurry which is introduced to the annulus moves upwardly in the annulus between the liner and the borehole. As the cement slurry travels upwardly in the annulus, it displaces the drilling mud in the well bore above the cement. If the liner is reciprocated and/or rotated during the cementing operation, this movement will greatly assist the obtaining of a uniform distribution of the cement in the annulus and proper displacement of the drilling mud in the annulus without channeling of the cement through the mud.

In recent years liner hangers have incorporated a rotatable bearing between horizontal load bearing surfaces in the liner hanger so that when the slips of the liner hanger are set and the liner is suspended by the liner hanger slips from the next above string of well pipe, the liner is supported by a rotational bearing on the liner hanger cone or expander. The rotational bearing then facilitates rotation of the liner hanger relative to the cone after setting the liner hanger slips. Examples of rotatable load bearing bearings and liner hangers are shown in U.S. Pat. No. 4,033,640 and U.S. Pat. No. 4,190,300.

In order to rotate the liner during the cementing operation, the released setting tool must be co-rotatively coupled to the liner hanger so that rotation of the string of pipe can permit the liner to be rotated as much as desired during the cementing operation. It is desirable that the setting tool remain released from the threaded connection with the liner hanger so that it can be pulled out of the well by only an upward movement of the drill string at any time during the operation.

Prior art systems for rotating liner hangers and setting tools prior to setting of the slips are well known and typically utilize a single set of splines. In U.S. Pat. No. 4,562,889 and co-pending patent application Ser. No. 609,104, filed May 10, 1984, dual spline arrangements are shown where a second set of splines can be selectively engaged after the release of the release nut so that the liner and setting tool can be co-rotatively rotated while the release nut is released from the threaded coupling. These systems however require extra spline housing components in the liner hanger and a special setting tool which does not have a universal use.

When the liner hanger for the liner is set in the casing, it is set so the bottom of the cement shoe on the liner is located above the bottom of the borehole a sufficient distance to eliminate the possibility of fouling of the cement shoe orifices and so that the liner hanger slips can engage the next above casing or liner. As may be appreciated, the cementing operation requires considerable care because once the cement slurry is in the annulus of the liner and the borehole, removal or repositioning of the liner may not be possible since the cement slurry is already in place. Also, if the nut releasing mechanism in the setting tool is not disengaged from the liner hanger prior to the cement slurry hardening up, the drill string on the setting tool can be hung up in place. Such malfunctions can result in the loss of well equipment in the well or even destroying the well.

SUMMARY OF THE INVENTION

The present invention involves a setting tool for a liner hanger which incorporates a coupling mechanism for co-rotatively interconnecting the setting tool and the liner hanger prior to and after release of the release nut from a liner hanger. This simplifies the liner hanger construction and eliminates the need for additional structure to achieve co-rotation. The liner hanger which is connected to a liner is provided at its upper end with only left hand internal threaded section which threadedly receives the release nut on a setting tool and upwardly facing clutch surfaces on an end surface of the liner hanger.

The setting tool is adapted for connection with a tubing string or drill string and has a tubular mandrel with a longitudinally extending spline recess or slots where the spline recesses are located between a lower release nut and an upper rotatable bearing assembly. The release nut has an external thread to threadedly connect to an internal thread in the liner hanger. The release nut has a central bore which is slidably and non-rotatively coupled to a non-circular section of the setting tool mandrel. A tubular clutch housing on the setting tool mandrel is releasably connected to the setting tool mandrel by a shear pin. The clutch housing has longitudinal spline dogs interengaged with the spline recesses or slots in the mandrel and has downwardly facing clutch fingers or portions which interengage with the upwardly facing clutch surfaces in the top end of the liner hanger. The clutch surfaces can be disengaged by lifting of the clutch housing upwardly relative to the liner hanger.

In a casing and in a condition as described above, the liner hanger is co-rotatable with the setting tool mandrel prior to setting the slips of the liner hanger by virtue of the interengaging spline dogs with the splines recesses and the interengaging clutch surfaces. When the liner hanger is in position for setting, the liner hanger slips can be set mechanically or hydraulically when the liner is properly located.

After setting the liner hanger slips, the tubing string and the setting tool are lowered to shear the connecting shear pin between the clutch housing and the setting tool mandrel and to disengage the spline dogs on the clutch housing from the spline recesses on the setting tool mandrel so that the mandrel can be rotated by the string of tubing to release the release nut from the threaded connection with the liner hanger. The setting tool mandrel is lowered until the rotatable bearing on the setting tool mandrel engages the clutch housing and holds the clutch surfaces in interengagement. In a recess in the clutch housing above the release nut is a lock nut which is slidably and non-rotatively mounted on the non-circular portion of the setting tool mandrel. The lock nut is in a longitudinal and spaced relationship relative to the release nut and interconnected by a coupling member. The lock nut is threadedly connected to an internal thread in the clutch housing. When the dogs on the clutch housing are released from the spline recesses on the mandrel, rotation of the setting tool mandrel causes both the release nut and the lock nut on the setting tool mandrel to move longitudinally by virtue of the threaded connections. After a given number of rotations, the release nut is threadedly disengaged from the liner hanger threaded connection by the rotation and the setting tool is released or disconnected from the liner hanger. The setting tool mandrel is then rotated further until the lock nut is jammed into a locking relationship with the top of the recess in the clutch housing. When the lock nut jams or locks with the clutch housing, then further rotation of the setting tool mandrel rotates the clutch housing (and liner hanger) through the lock nut and the interengaged clutch fingers while the liner hanger is set and while the release nut of the setting tool is released from the liner hanger.

In the Drawings

DETAILED DESCRIPTION OF THE INVENTION

Figure 1:
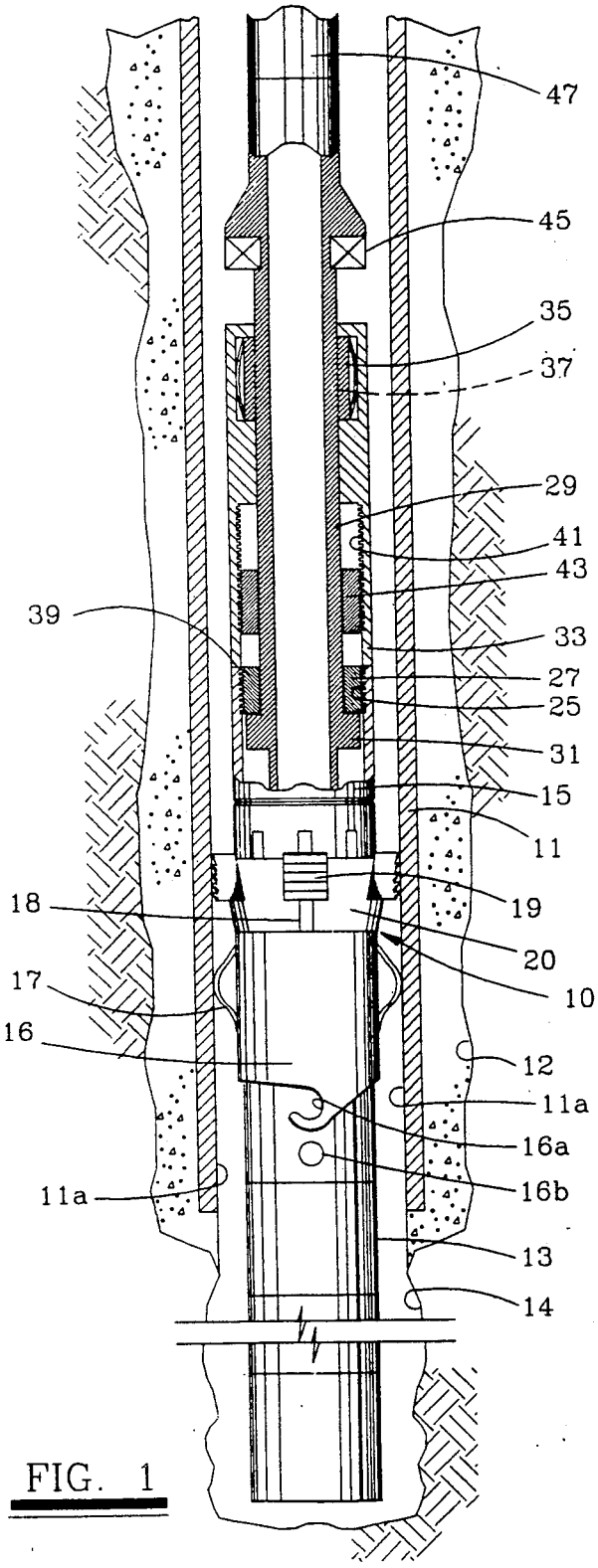
FIG. 1 is an overall schematic view of a liner hanger disposed in a well bore.

Referring now to FIG. 1, a liner hanger assembly 10 is shown in a set position at the lower end of a well casing 11 which has been cemented in a borehole 12. The liner hanger assembly 10 is coupled to a lower depending liner 13 to be cemented in a borehole 14 located below the liner hanger assembly 10.

Figure 2:
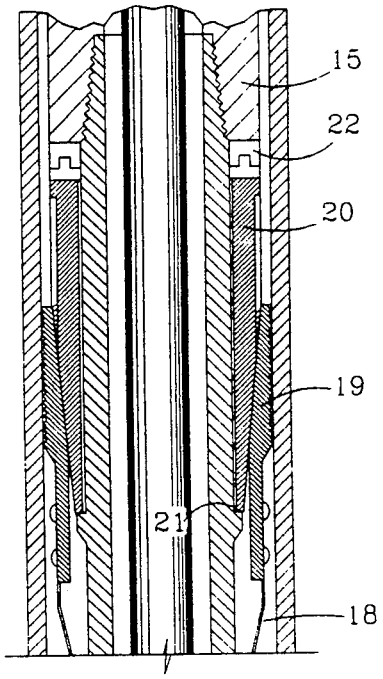
FIG. 2 is a view in longitudinal cross section of the expander cone as related to the supporting member to facilitate ease of rotation.

The liner hanger assembly 10 includes a tubular hanger member 15 which is coupled by a threaded connection to the liner 13. The tubular hanger member 15 carries at its lower end, a tubular J-slot sleeve or cage 16 which has J-hooks or J-slots 16A which are adapted to be releasably connected with respect to J-pins 16B on the hanger member 15. The tubular cage 16 has external friction pads or springs 17 which frictionally engage the interior wall 11A of the casing 11 and prevent the cage 16 from relative rotational movement during the latching or unlatching of the J-pins from the J-hooks. The J-slot cage 16 is attached by longitudinally extending straps 18 to slip members 19 which are circumferentially disposed about the periphery of the hanger member 15. (See also FIG. 2). The slip members 19 have inner tapered surfaces which slide upon an inclined expander cone 20. The expander cone 20 is rotatively mounted on the hanger member 15 between a lower stop shoulder 21 and an upper rotatable bearing 22 (FIG. 2).

The liner hanger assembly 10 at its upper end has an internal left-hand thread 25 for threaded coupling to a releasable coupling or release nut 27 on a setting tool mandrel 29. The setting tool mandrel 29 has a slidable but non-rotatable connection with the coupling nut 27 and has a flange or shoulder 31 below the coupling nut which supports the load of the liner through the coupling nut 27. A tubular clutch housing 33 has resiliently biased dogs 35 in meshing engagement with spline slots 37 (dash line, FIG. 1) in the setting tool mandrel 29. The clutch housing has clutch surfaces at 39 which mesh with clutch surfaces on the upwardly facing end of the liner hanger member 15. Thus, prior to setting the slips 19 and with the weight of the liner 13 on the coupling nut 27, the dog and slot interconnections 35, 37 permit the setting tool mandrel 29 to be rotatively coupled to the liner hanger 10 by virtue of the dog and slot interconnections 35, 37 and the clutch surfaces interconnection at 39.

The clutch housing 33 has an internal left-hand thread 41 which is threadedly engaged by a lock nut 43. The lock nut 43 is slidably but non-rotatively mounted on the mandrel 29. After setting the slips 19 (shown in FIG. 1), the setting tool mandrel 29 is lowered, which uncouples or disengages the dogs 35 from the spline slots 37. The mandrel 29 is lowered until a bearing 45 on the setting tool mandrel 29 engages the upper end of the clutch housing 33. Right-hand rotation of the setting tool mandrel 29 rotates the coupling nut 27 and the lock nut 43 so that both nuts move upwardly relative to the setting tool mandrel 29. After about ten turns, the coupling nut 27 disengages from its threaded connection with the liner hanger 10. Thereafter, in about two or three additional turns, the lock nut 43 jams up against the top of the recess in the clutch housing 33. The down weight on the string of tubing 47 is transmitted through the bearing 45 to maintain the clutch surfaces at 39 in engagement and the lock nut 43 in a jamming engagement with the clutch housing 33 and non-rotatively coupled to the mandrel enables rotation of the clutch housing. Hence the liner 13 can be rotated after the liner hanger slips 19 are set.

Figure 3:
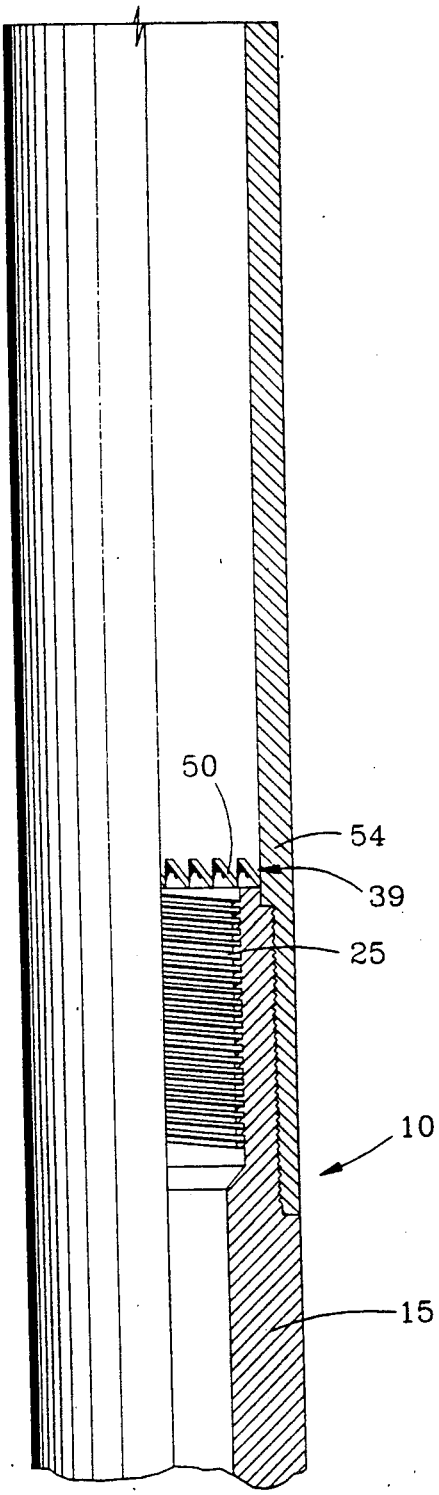
FIG. 3 is an illustration of the upper end of a liner hanger which is modified to have clutch fingers.

Referring now to FIG. 3, the upper end of the liner hanger assembly 10 is illustrated with its internal left-hand thread 25 for threaded coupling to the coupling nut 27 of the setting tool. On the upwardly facing end surface of the liner hanger member 15 are circumferentially arranged, upwardly extending clutch teeth or surfaces 50 which are arranged in a saw tooth relationship so as to mesh or engage with downwardly facing clutch teeth or surfaces 52 on the clutch housing 33 (FIG. 4) on the setting assembly. The clutch teeth or surfaces 50, 52 can be engaged by moving the clutch surfaces 52 on the clutch housing 32 downward into the clutch surfaces 50 on the hanger member 15. Conversely, the clutch surfaces 50, 52 can be disengaged from one another by longitudinally moving the clutch housing 33 in an upward direction relative to the hanger member 15. A tubular guide housing 54 may be threadedly coupled to the upper end of the liner hanger member 15 to protect the teeth 50 and provide a guiding function. As may well be appreciated no special housings or construction is required on the liner hanger and the member 15 can be easily and economically fabricated.

Figure 5:
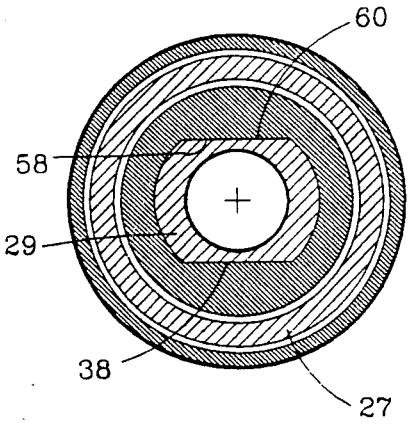
FIG. 5 is a view in cross section taken along line 5—5 of FIG. 6.
Figure 4:
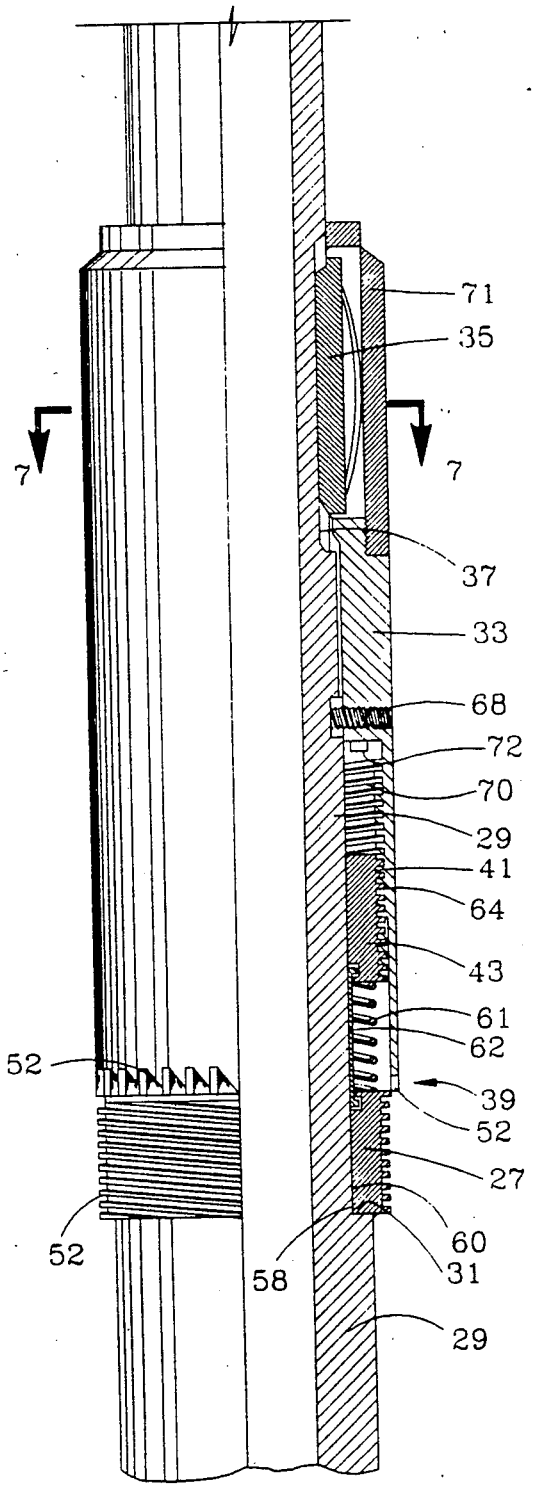
FIG. 4 is an illustration of the setting tool assembly of the present invention

In the setting tool as illustrated in FIG. 4, the setting tool mandrel 29 has a coupling nut 27 which is normally seated on a load supporting shoulder 31 on the mandrel 29. The coupling nut 27 has an external left-hand machine thread and an internal bore 58 with a non-circular cross section (see FIG. 5) which slidably and co-rotatively receives a non-circular cross section 60 of a length of the mandrel 29.

The setting tool mandrel 29 and the coupling nut 27 are part of the setting tool assembly which also includes a lock nut member 43 which is also slidably but non-rotatively mounted on the mandrel similar to the nut 27. The lock nut member 43 has a non-circular bore which is slidably and co-rotatively coupled to the non-circular cross section 60 of the mandrel 29. (See FIG. 5). Between the coupling nut 27 and the lock nut 43 is a compressed spring 61. The spring 61 is located around a coupling sleeve 62 which is slidable along the mandrel. The sleeve 62 has edge flanges loosely received in annular retaining grooves in the ends of the nuts 43 and 27 so that the nuts are effectively coupled to one another. It is possible to use a single nut but this may cause some problems. The spring 61 and the sleeve 62 provide a flexible longitudinal coupling relationship between the nuts 27 and 43 to facilitate assembly.

The lock nut 43 has an external left hand thread 64 which engages an internal left-hand thread 41 in the tubular clutch housing 33. The clutch housing 33 has a shear pin 68 which is received in an annular groove in the mandrel. The shear pin 68 maintains the clutch housing 33 releasably attached to the setting tool mandrel 29 until the pin 68 is sheared and assures the interconnection of the clutch surfaces at 39 while the tool is going in the borehole. At the upper end of the clutch housing 33 is an internal, longitudinally extending dog or lug means 35 which is shown in an engaged position in longitudinally extending spline groove or recess means 37 in the setting tool mandrel 29. The spline groove means 37 are circumferentially disposed about the mandrel and receive the elongated spline lugs 35 which are biased inwardly by springs into the outer surface of the setting tool mandrel. An outer cover sleeve 71 is threadedly coupled to the upper body portion of the clutch housing and encloses the springs 35 between the outer sleeve 71 and the lugs 35. As illustrated, the spline lugs 35 are arranged to be slidably received in the spline recesses 37 which are sized to be slightly greater in length than a lug. The spline recesses 37 and the spline lugs 35 are circumferentially disposed about the mandrel. Thus, with the clutch teeth or surfaces 50, 52 meshed, the shear pin 68 intact and the spline lugs 35 in the spline recesses 37, rotation of the setting tool mandrel 29 can be imparted to the liner hanger member 15 to rotate the liner hanger.

Figure 7:
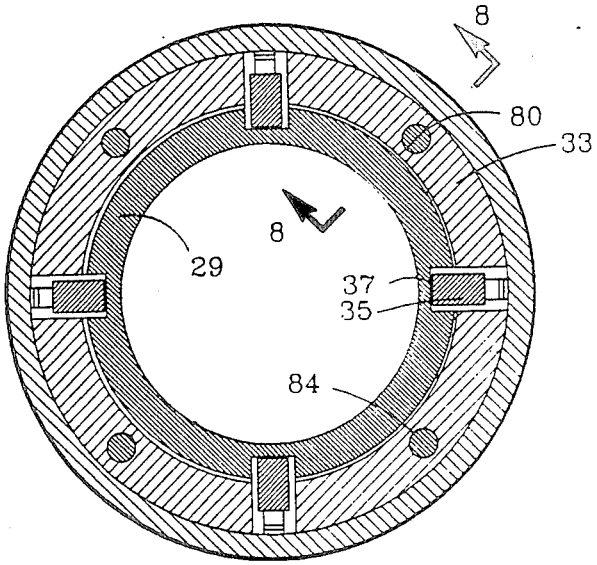
FIG. 7 is a view in cross section taken along line 7—7 of FIG. 4.
Figure 8:
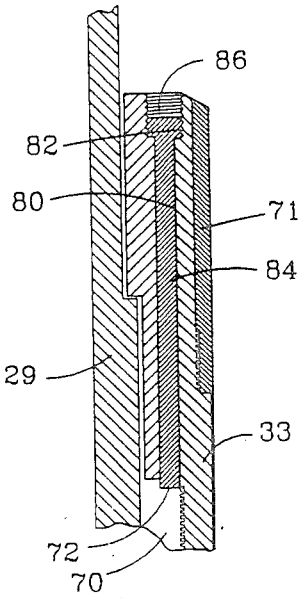
FIG. 8 is a view in partial longitudinal cross section taken along line 8—8 of FIG. 7.

As shown in FIG. 7 and FIG. 8, the clutch housing 33 has circumferentially spaced bores 80 which extend longitudinally through the housing 33. The bores 80 have counterbores 82 and a threaded opening at their upper end and the bores 80 respectively receive relief rod members 84. A rod member 84 is seated in a counterbore 82 and held in place by a cap screw 86 and has a lower end projecting outwardly into the recess 70 in the clutch housing 33 to provide an end surface 72 for abutment of the lock nut. It can be appreciated that the jamming of the lock nut 43 against the end surface of the clutch housing can have considerable tightness. Thus, after use in a well bore, the cap screws 86 and rods 84 which can absorb the loading can be removed first so that the binding forces on the lock nut are removed and the lock nut 43 can be easily removed from the clutch housing for resetting the next operation.

The setting tool as shown in FIG. 4 is assembled with the liner hanger as shown in FIG. 3, with the threaded coupling nut 27 in threaded engagement with the threads 25 on the liner hanger; the clutch teeth 52 on the clutch housing in engagement with the clutch teeth 50 on the liner hanger; the spline lugs 35 in engagement with the spline grooves 37 of the setting tool. The shear pin 68 assures that the clutch teeth 50, 52 will not be accidentally disengaged. As such, the setting tool, liner hanger and liner can be lowered into the well bore by a tubing string to the desired location. At any time rotation and/or reciprocation of the tubing string will produce rotation or reciprocation of the liner without affecting the setting tool coupling arrangement.

Figure 6:
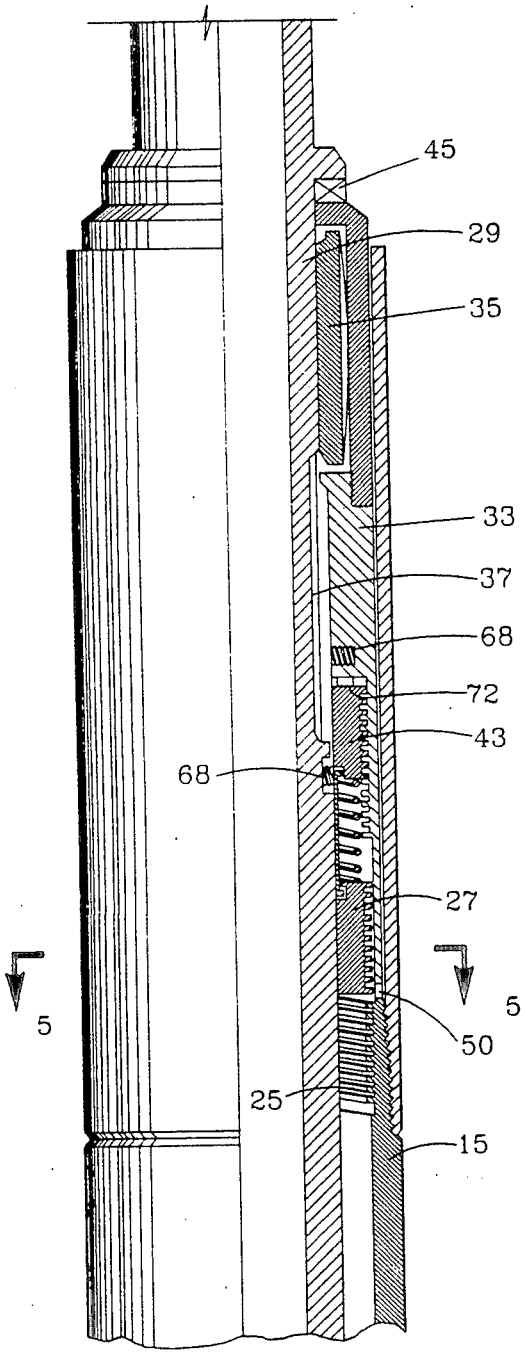
FIG. 6 is a view in cross section of a setting tool and liner hanger in position to rotate a liner after the liner is hung.
Figure 9:
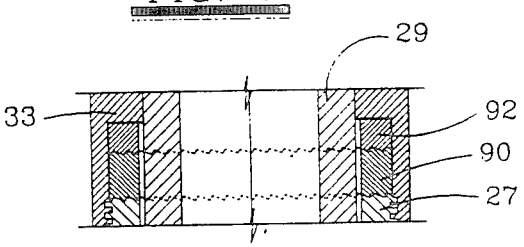
FIG. 9 is another form of nut release mechanism.

At a desired location in the well bore, the liner hanger slips are set to hang the liner in the well bore and support the weight of the liner on the liner hanger slips. Next the tubing string is slacked off (lowered) to apply sufficient weight to shear the pin 68 and move the spline slots 37 downwardly and release the spline interconnection with the lugs 35 on the clutch housing (see FIG. 6). The tubing string 47 is lowered until a bearing 45 on the setting tool mandrel 29 engages the clutch housing 33 and applies weight to maintain the clutch teeth 50, 52 at 39 in engagement. Following this downward stroke, the tubing string is rotated in a right-hand direction to co-rotatively rotate the release nut 27 and the lock nut 43. The release nut 27 unscrews from the threaded connection with the liner hanger while the lock nut 43 moves upwardly in the internal recess 70 in clutch housing 33. The arrangement is such that the release nut 27 uncouples from the liner hanger 15 prior to the lock nut engaging the end surface 72 in the recess 70 in the clutch housing 33. After the release nut 27 is free or released from the liner hanger thread 25, further rotation causes the lock nut to engage the end surface 72 in the clutch housing recess 20. (See FIG. 6). This engagement of the lock nut 43 locks the mandrel 29 to the clutch housing 33. Since the clutch housing is coupled by the clutch fingers 50, 52 to the liner hanger, rotation of the mandrel rotates the liner hanger and liner after the liner hanger is set and while the setting tool is released from the liner hanger. Thus, if a complication arises during cementing, the operator can pull up and retrieve the setting tool and tubing string from the liner As shown in FIG. 9, instead of the rods 84, annular rings 90, 92 can be located at the upper end of the recess 70. The rings 90, 92 are provided with interengaging teeth which will absorb loading of the nut 43. When the forces are removed, the teeth impart a reversing force to assist in the release of the nut 27.

It will be apparent to those skilled in the art that various changes may be made in the invention without departing from the spirit and scope thereof and therefore the invention is not limited by that which is enclosed in the drawings and specifications, but only as indicated in the appended claims.

I claim:

1. A setting tool and liner hanger system for use in rotating a liner hanger prior to and subsequent to setting of a liner hanger, said system including:

a tubular liner hanger having a internal threaded coupling for releasable coupling to a setting tool, and means for hanging a liner in a well casing;

a setting tool having an external threaded nut for releasable coupling to an internal threaded coupling in a liner hanger;

first coupling means on said setting tool including a clutch housing for releasably coupling to a liner hanger for imparting rotation thereto when coupled;

second coupling means on said setting tool for releasably coupling said clutch housing to said setting tool for imparting rotation thereto when coupled;

nut means on said setting tool for selectively co-rotatively coupling said clutch housing to said setting tool upon release of said second coupling means;

said second coupling means being operative prior to hanging a liner in a well casing and being releasable by to permit setting tool rotation to release said external threaded nut from said internal threaded coupling and to actuate said nut means to couple said clutch housing to said setting tool so that said liner hanger can be rotated after said external nut is released from said internal threaded coupling.

2. The apparatus as set forth in claim 1 wherein said external threaded nut and said nut means are co-rotatively and slidably mounted on a setting tool mandrel.

3. The apparatus as set forth in claim 1 wherein said first coupling means includes interengaging clutch surfaces on said clutch housing and said liner hanger.

4. The apparatus as set forth in claim 1 wherein said second coupling means includes a longitudinal spline dog and groove interconnection.

5. The apparatus as set forth in claim 3 wherein said second coupling means further includes a shear pin.

6. A setting tool and liner hanger system for enabling rotation of a liner hanger and attached liner through rotation of a setting tool and an attached string of tubing prior to and subsequent to setting of a liner hanger, said system including:

a liner hanger having an internal coupling thread at one end thereof, and having wall engaging means for gripping a casing wall to suspend a liner in a well bore and having bearing means for enabling rotation of a liner relative to the wall engaging means;

a setting tool having a load supporting tubular mandrel with a coupling nut having an external coupling thread to releasably couple the setting tool to the internal coupling thread on said liner hanger, said coupling nut being slidably and co-rotatively coupled to said mandrel;

a clutch housing slidably disposed on said mandrel, said clutch housing having clutch means for releasably coupling to said liner hanger, said clutch housing having an internal recess with an internal threaded section;

lock nut means slidably and co-rotatively coupled to said mandrel, said lock nut means having an external thread in engagement with said internal threaded section on said clutch housing;

interconnecting means for releasably interconnecting said clutch housing to said mandrel and maintaining said clutch means coupled to said liner hanger so that said liner hanger can be rotated with said setting tool prior to release of said setting tool from said liner hanger; and said mandrel being manipulatable relative to said clutch housing upon release of said interconnecting means for enabling limited rotation of said mandrel relative to said liner hanger to release said coupling nut from said liner hanger and to lock said lock nut means with said clutch housing so that said mandrel can rotate said liner hanger after release of said coupling nut from said liner hanger.

7. The apparatus as set forth in claim 6 wherein said clutch means includes interengaging surfaces on said clutch housing and said liner hanger.

8. The apparatus as set forth in claim 6 wherein said interconnecting means includes longitudinally extending spline dogs and spline pockets in said clutch housing and grooves in said mandrel.

9. The apparatus as set forth in claim 6 wherein said outer connecting means includes a shear pin.

10. The apparatus as set forth in claim 6 wherein said coupling nut and said lock nut means are separate members.

11. The apparatus set forth in claim 6 wherein said clutch housing has releasable load supporting means extending into the internal recess in the clutch housing for engaging said lock nut means in a locking condition of the nut means, and means for selectively releasing said supporting means from said nut means for relieving locking forces between said nut means and said supporting means.

12. The apparatus as set forth in claim 11 wherein said load supporting means includes longitudinally extending rod members disposed in said clutch housing and extending into said internal recess.

13. The apparatus as set forth in claim 11 wherein said load supporting means includes a ring member with teeth surfaces arranged to absorb and release load forces.

14. A setting tool for use in rotating a liner hanger prior to and subsequent to setting of a liner hanger, said setting tool including:

a setting tool mandrel having an external threaded nut for releasable coupling to an internal threaded coupling in a liner hanger;

first coupling means on said setting tool including a clutch housing for releasably coupling to a liner hanger for imparting rotation thereto when coupled;

second coupling means on said setting tool for releasably coupling said clutch housing to said setting tool mandrel for imparting rotation thereto when coupled;

nut means on said setting tool mandrel for selectively co-rotatively coupling said clutch housing to said setting tool mandrel upon release of said second coupling means;

said second coupling means being operative prior to hanging a liner in a well casing and being releasable to permit setting tool mandrel rotation to release said external threaded nut from a liner and to actuate said nut means to couple said clutch housing to said setting tool mandrel so that said liner hanger can be rotated after said external nut is released from a liner hanger.

15. The apparatus as set forth in claim 14 wherein said external threaded nut and said nut means are co-rotatively and slidably mounted on said setting tool mandrel.

16. The apparatus as set forth in claim 14 wherein said first coupling means includes interengaging clutch surfaces on said clutch housing for engaging a liner hanger.

17. The apparatus as set forth in claim 14 wherein said second coupling means includes a longitudinal spline dog and groove interconnection.

18. The apparatus as set forth in claim 16 wherein said second coupling means further includes a shear pin.

19. A setting tool for rotating a liner hanger prior to and subsequent to setting of a liner hanger, said setting tool including:

a load supporting tubular mandrel with a coupling nut having an external coupling thread to releasably couple the setting tool to a liner hanger, said coupling nut being slidably and co-rotatively coupled to said mandrel;

a clutch housing slidably disposed on said mandrel, said clutch housing having clutch means for releasably coupling to a liner hanger, said clutch housing having an internal recess with an internal threaded section;

lock nut means slidably and co-rotatively coupled to said mandrel, said lock nut means having an external thread in engagement with said internal threaded section on said clutch housing;

interconnecting means for releasably interconnecting said clutch housing to said mandrel and maintaining said clutch means coupled to a liner hanger so that a liner hanger can be rotated with said setting tool prior to release of said setting tool from a liner hanger; and said mandrel being manipulatable relative to said clutch housing upon release of said interconnecting means for enabling limited rotation of said mandrel relative to a liner hanger to release said coupling nut from a liner hanger and to lock said lock nut means with said clutch housing so that said mandrel can rotate a liner hanger after release of said coupling nut from a liner hanger.

20. The apparatus as set forth in claim 19 wherein said coupling nut and said lock nut means are separate members.

21. The apparatus set forth in claim 19 wherein said clutch housing has releasable load supporting means extending into the internal recess in the clutch housing for engaging said lock nut means in a locking condition of the nut means, and means for selectively releasing said supporting means from said nut means for relieving locking forces between said nut means and said supporting means.

22. The apparatus as set forth in claim 21 wherein said load supporting means includes longitudinally extending rod members disposed in said clutch housing and extending into said internal recess.

23. The apparatus as set forth in claim 21 wherein said load supporting means includes a ring member with teeth surfaces arranged to absorb and release load forces.

* * * * *